US005228714A

United States Patent [19]

Dekanovsky

[11] Patent Number: 5,228,714

[45] Date of Patent: Jul. 20, 1993

[54] CROSS-COUNTRY SKI BINDING

[75] Inventor: Walter Dekanovsky, Munich, Fed. Rep. of Germany

[73] Assignee: Witco A-S, Norway

[21] Appl. No.: 777,388

[22] PCT Filed: Jan. 18, 1991

[86] PCT No.: PCT/EP91/00090

§ 371 Date: Dec. 4, 1991

§ 102(e) Date: Dec. 4, 1991

[87] PCT Pub. No.: WO91/15273

PCT Pub. Date: Oct. 17, 1991

[30] Foreign Application Priority Data

Apr. 4, 1990 [DE] Fed. Rep. of Germany ..... 4010929

[51] Int. Cl.[5] ..... A63C 9/086

[52] U.S. Cl. ..... 280/615

[58] Field of Search ..... 280/614, 615, 626, 631; 267/140.3, 141, 153

[56] References Cited

U.S. PATENT DOCUMENTS 4,659,103 4/1987 Tessaro ..... 280/615

4,927,168 5/1990 Provence et al. ..... 280/615

4,995,632 2/1991 Girault et al. ..... 280/615

5,052,710 10/1991 Provence et al. ..... 280/615

5,085,454 2/1992 Provence et al. ..... 280/615

5,087,065 2/1992 Provence et al. ..... 280/615

*Primary Examiner*—Margaret A. Focarino

*Assistant Examiner*—Michael Mar

*Attorney, Agent, or Firm*—Andrus, Sceales, Starke & Sawall

[57] ABSTRACT

A cross-country ski binding for locking a shoe (11) on a cross-country or touring ski (12), the shoe (11) being allowed to pivot relative to an axis (13) which is normal to the longitudinal axis of the ski, in which the front end (14) of the shoe (11) is provided with pivoting means which are complementary to pivoting means of the binding (10), the binding comprising a flexor (15) acting between the front end (14) of the shoe and the binding (10) or ski (12), respectively, said flexor exerting a reaction force on the shoe (11) as the heel of the shoe is lifted off the top of the ski (12). The flexor (15) includes at least two flexor portions (16, 17), one (17) of said flexor portions being made of soft-elastic material while the other one (16) is made of hard-elastic material.

7 Claims, 4 Drawing Sheets

CROSS-COUNTRY SKI BINDING

BACKGROUND OF THE INVENTION

The invention is directed to a cross-country ski binding as defined in the preamble of patent claim 1. Such ski bindings are generally known. The known designs exhibit the drawback that the reaction force of the flexor, which acts between shoe and binding or ski, respectively, exhibits a highly progressive increase as the heel of the shoe is lifted. This progressive increase of the reaction force is unnecessary; on the contrary, it takes up strength and is correspondingly energy-consuming.

It is therefore the object of the present invention to provide a ski binding of the above-specified kind with a flexor in such a way that the reaction force of the flexor increases only slightly over nearly the entire range of action thereof. It is a further object of the invention to minimize the energy consumed by the flexor.

SUMMARY OF THE PRESENT INVENTION

The aforementioned objects are solved in accordance with the invention by providing at least two flexor portions in the flexor. One portion is made of soft-elastic material and the other said flexor portion (16) is made of a hard-elastic shell which extends across the longitudinal direction of the ski and within which the soft-elastic flexor portion (17) is located. Advantageous further improvements and embodiments of the inventive concept are set down in the subclaims.

Due to the design in accordance with the present invention it is possible to make or adjust the flexor in such a way that the reaction force will either not increase or will increase only slightly over the entire range of action, preferably over about 60 to 80% of said range. It is unavoidable in some designs that the reaction force increases progressively in the final stage of flexor compression. But this applies only to the final part of the load phase, i.e. to a very small part of the overall range of action of the flexor, and consequently the additional expenditure of energy caused thereby is negligible as compared with the prior art.

It is of particular importance with respect to the desired effect that the soft-elastic or compliant flexor portion is able to escape into a free space on application of a load. In the one embodiment, the contact load on the flexor is accommodated by the hard-elastic flexor portion which is preferably made of a material exhibiting a low coefficient of friction. Essentially, the hard-elastic flexor portion has two functions which may either be dependent on or independent of each other. The hard-elastic flexor portion may have the exclusive function to hold the soft-elastic flexor portion, in which case it is preferred that a positive mounting is respectively provided between the hard-elastic flexor portion and the binding or the ski, on the one hand, and the soft-elastic flexor portion and the hard-elastic flexor portion, on the other hand. However, the hard-elastic flexor portion may simultaneously serve as a separating element between the ski shoe and the soft-elastic flexor portion so that the latter is merely compressed by the tip of the ski shoe and need not participate in the arc-like movement of the tip of the ski shoe, thus contributing to a minimum increase in the reaction force of the flexor.

In the embodiment of the flexor in which merely a soft-elastic flexor portion has to be provided, the desired non-increase in the reaction force is achieved due to the undulated or wave-shaped lateral boundary walls of the flexor, which is configured as a hollow body. Due to the wave-like lateral boundary walls the respective adjacent flanks of the undulations may be compressed without any increase, or with only a slight increase, of their reaction forces, whereby the desired effectiveness of the flexor is achieved. Of course, it should be observed that the compression with a substantially uniform reaction force of the flexor is completed by the time the flanks are in contact with each other. In case of any further compression the reaction force would be increased because the flank portions of the wall would not only be deformed but would themselves be compressed.

An advantageous further improvement of the invention resides in that the hard-elastic flexor portion is configured as an approximately U-shaped profile shell—as viewed in the vertical longitudinal section—the free ends of said shell grasping the soft-elastic flexor portion in hook-fashion and positively securing it thereby. In this embodiment the soft-elastic flexor portion may freely escape upwardly and laterally upon compression. The wave crests, which upon compression expand slightly outwardly, will not be obstructed thereby. It is preferred that the wave-like boundary wall of the soft-elastic flexor portion extends only across the top and the sides so that the cavity of the soft-elastic flexor portion is open at the bottom. Also, it is an advantage that upright cross-walls are formed within the cavity of the soft-elastic flexor portion in one piece with the outer boundary wall, said cross-walls being joined to the boundary wall in the vicinity of the internal wave crests; the flexor is thereby dimensionally stabilized.

It is preferred that the rigidity or reaction force of the flexor should be adjustable, especially by means of elements of different rigidity, for instance rod or block elements of more or less elastic material which can be fitted into the soft-elastic core. To this end the soft-elastic flexor portion is provided with corresponding receptacles, especially through-holes extending across the longitudinal direction of the ski. The embodiment defined in claim 19 is also particularly well suited to this purpose. This embodiment is characterized in that the soft-elastic core consists of a hollow-cylindrical or hollow-elliptical length of tubing into which a complementary element of predetermined rigidity may be inserted if desired by the user.

BRIEF DESCRIPTION OF DRAWINGS

Below, preferred embodiments of the invention will be explained in detail with reference to the accompanying drawing, in which.

DESCRIPTION OF THE ILLUSTRATED EMBODIMENT

Figure 1:
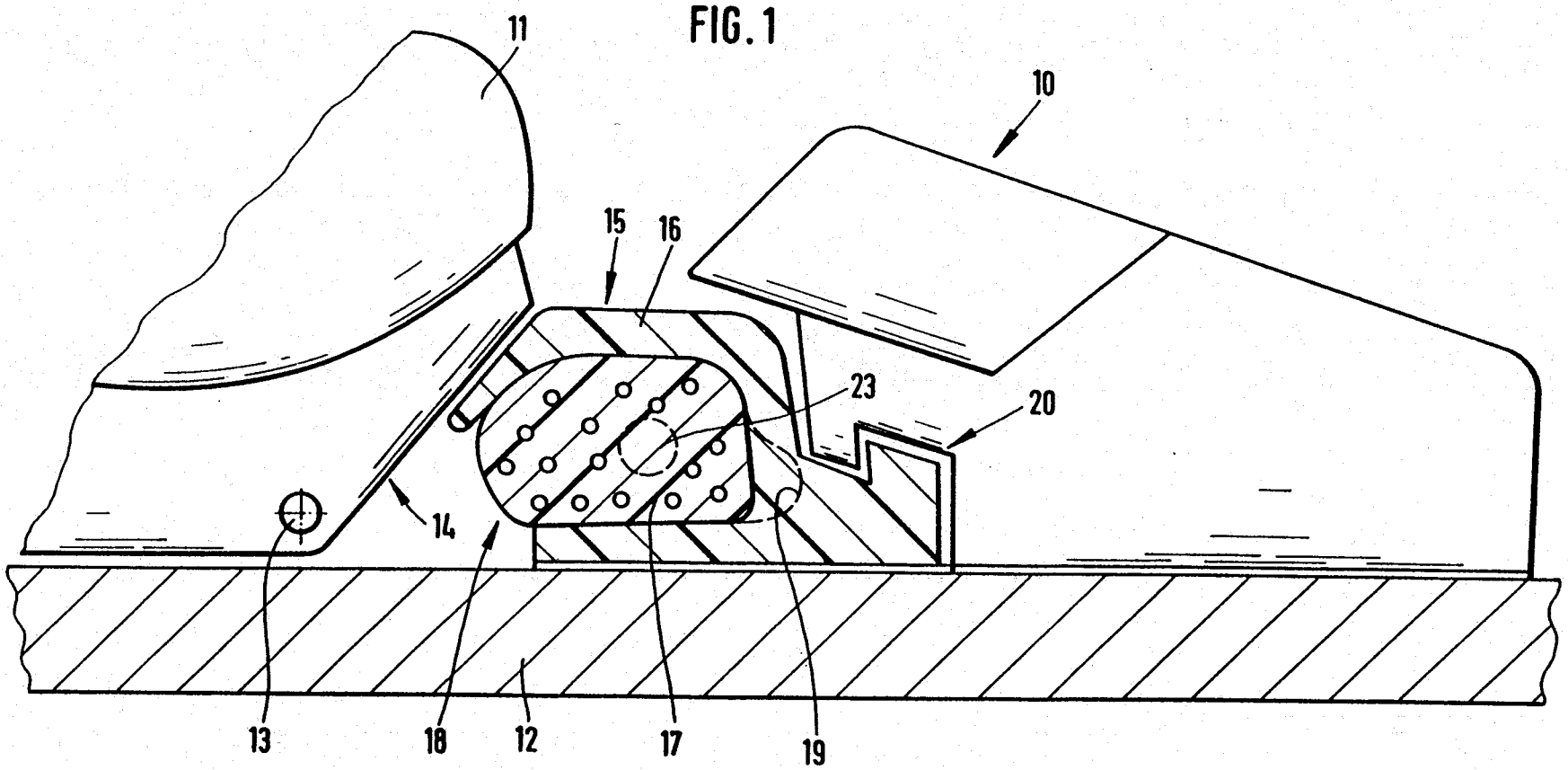
FIG. 1 is a schematic partial view/schematic cutaway part of an embodiment of a cross-country ski binding according to the invention, with the ski shoe in non-elevated position.
Figure 2:
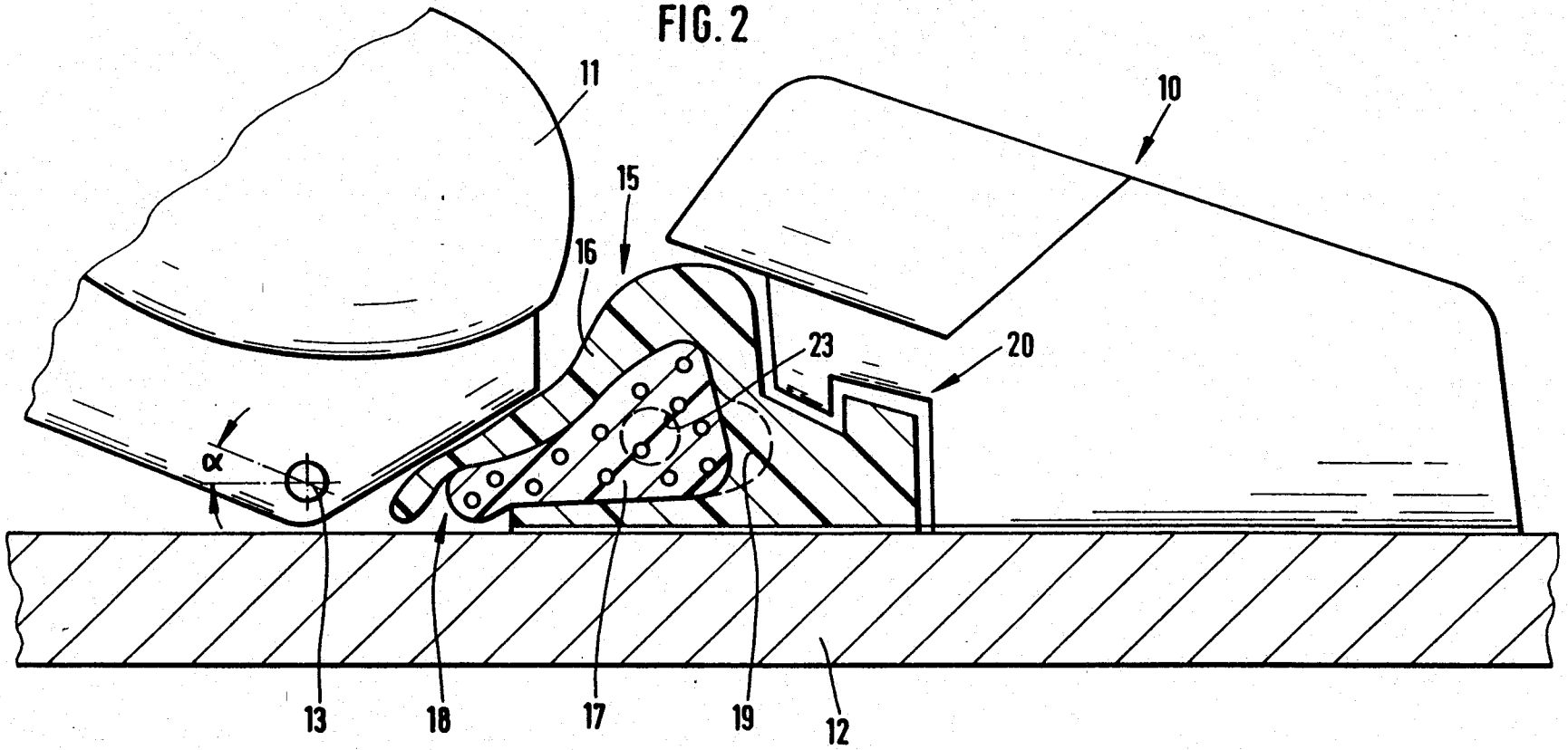
FIG. 2 is a view corresponding to the embodiment of FIG. 1 with the ski shoe elevated.

In FIGS. 1 and 2, 10 identifies a cross-country ski binding which is used for locking a shoe 11 on a cross-country or touring ski 12, in which the shoe 11 may be pivoted relative to an axis 13 normal to the longitudinal axis of the ski. To this end the front end 14 of the shoe 11 is provided with pivot means which are complementary with pivot means of the binding 10. The pivot means at the front end of the shoe 11 is defined, for example, by a pivot axis extending at the front end of the sole across the longitudinal direction of the shoe and co-operating with complementary retaining means (not illustrated in detail in FIGS. 1 and 2) of the binding 10. The illustrated cross-country ski binding is moreover provided with a flexor 15 acting between the front end 14 of the shoe and the binding 10 or the ski 12 and exerting a reaction force on the shoe 11 as the heel of the shoe is lifted off the top of the ski 12 or is pivoted upwards about the axis 13 of the above-mentioned pivot means about an angle "α" (see FIG. 2). In the illustrated embodiment the flexor 15 is preferably made of two flexor portions 16, 17, wherein the one flexor portion 17 is made of soft-elastic or compliant material and adapted under increasing loading of the flexor 15 relative to the other flexor portion 16 to escape into a free space 18 and/or 19. In the embodiment of FIGS. 1 and 2 the flexor is a composite member comprising a hard-elastic profile shell 16 and a soft-elastic core 17, the hard-elastic profile shell 16 enclosing the soft-elastic core 17 only partially. On the side facing the shoe 11 and on both longitudinal sides the hard-elastic profile shell 16 is open so that the soft-elastic core 17 may escape under load both sideways and towards the shoe 11. It is preferred that the hard-elastic profile shell 16 is formed on the side remote from the shoe 11 or facing the ski tip with an internal space 19 for receiving the soft-elastic core 17 into which space it may escape under load. This embodiment is especially advantageous as with increasing compression of the flexor 15 soft-elastic material will escape from the area between shoe and binding or ski body to enter an area which is, and will remain, substantially load-free. Thus, flexor material is displaced into a free space whereby the stiffness of the flexor 15 as a whole is readily adjustable within the meaning of the specified object.

The hard-elastic profile shell 16 of the flexor 15 is made of a material which has a low coefficient of friction. At least the area co-operating with the sole of the shoe is coated with a corresponding material such as Teflon (registered trademark). The flexor 15 is anchored in a manner known per se within the binding 10, for instance by interlocking, so that it may be securely retained while being readily exchangeable. The mentioned interlocking is indicated at 20 in FIGS. 1 and 2.

The hardness of the flexor 15 may be adjustable or variable, for instance by means of elements 23 of different hardness which may be fitted into the soft-elastic core 17. Such an element is indicated by 23 in FIGS. 1 and 2. It is approximately rod-like and is fitted into a respective cross-bore of the soft-elastic core 17.

It is also preferred that the soft-elastic core consists of a hollow-cylindrical or hollow-elliptical length of tubing. In that case flexor material may escape into the cavity defined by the length of tubing. The cavity may also be filled with more or less hard-elastic material, for instance in the form of individually insertable elements of the above-mentioned kind.

Figure 3:
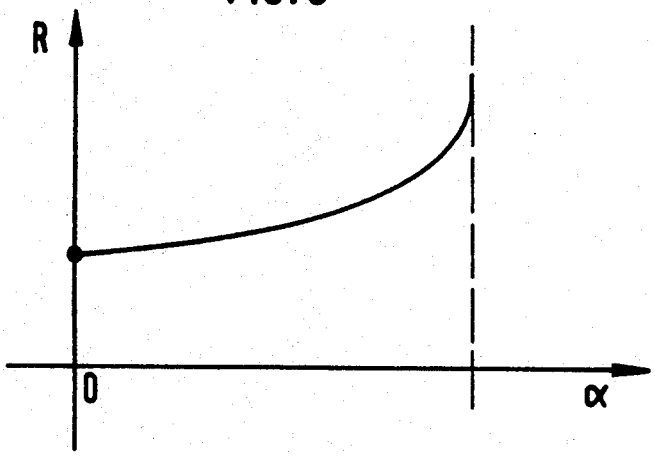
FIG. 3 illustrates the desired characteristic of the reaction force of the flexor in response to the angle included by the sole of the ski shoe and the top surface of the ski.

FIG. 3 shows the objective of the design according to the invention, i.e. the characteristic of the reaction force "R" of the flexor through the pivot angle "α" of the shoe 11 about the axis 13 of the above-mentioned pivot means between shoe and binding.

Figure 4:
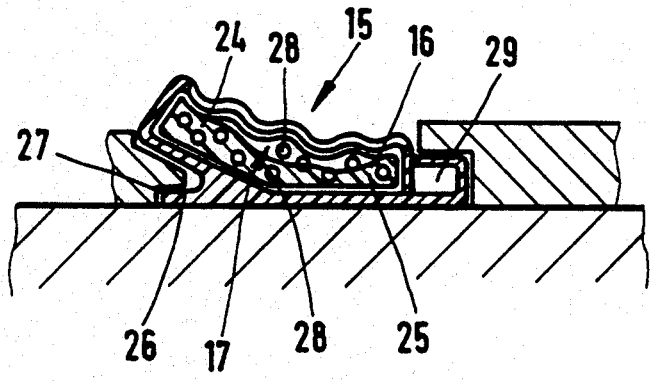
FIG. 4 is a schematic partial view/schematic cutaway part of a second embodiment of a binding in accordance with the invention.
Figure 5:
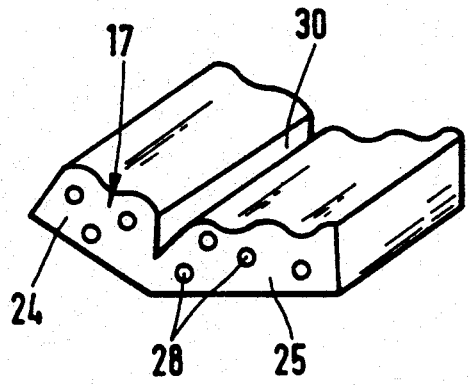
FIG. 5 is a perspective view of the soft-elastic flexor portion which is a modification of FIG. 4.

FIGS. 4 and 5 schematically illustrate further embodiments of a ski binding according to the invention, the difference between these two embodiments essentially residing in the configuration of the soft-elastic flexor portion 17.

As illustrated in FIG. 4, the soft-elastic core 17 consists of two sections 24 and 25 which in the longitudinal direction of the ski include an open-topped obtuse angle of about 120° to 140°, the outer supporting profile 16 being of corresponding or complementary design. The hard-elastic supporting profile 16 is configured like a tubing within which the soft-elastic core 17 may be positioned. The soft-elastic core 17 can be fitted sideways into the hard-elastic profile shell 16. The flexor 15 is held within the binding body such that the soft-elastic core 17 cannot slip out of the hard-elastic profile shell 16. The soft-elastic core 17 can be exchanged for another one (for instance one of different rigidity) only externally of the binding body.

In the embodiment of FIG. 4 the soft-elastic core 17 is distinguished by cross-bores 28, the density and/or the diameter of these cross-bores 28 being a measure of the hardness of the core 17.

The hard-elastic profile shell 16 is additionally provided with a forwardly projecting fixing lug 26 which co-operates with a corresponding receptacle 27 in the binding body whereby a kind of snap connection is formed. The front end of the hard-elastic supporting profile 16 is provided with a profile extension 29 adapted to be inserted in a complementary recess formed in the forward part of the binding body. The flexor 15 having the described configuration is easily mounted and dismounted, on the one hand, while on the other hand it is securely fixed for use within the binding body. The fixing lug 26 is formed approximately in the centre of the ski and extends across one-third of the flexor width. The receptacle 27 in the binding body is correspondingly configured. Furthermore, the fixing lug 26 is of course flexible so that the above-mentioned snap connection may be obtained.

The upper side of the flexor 15 is undulated whereby flexor compression is promoted. This applies both to the hard-elastic profile shell 16 whose upper wall is formed by transversely extending undulations and to the soft-elastic core 17 the top of which may be formed with transversely extending undulations. In this respect the core 17 may either fill the profile 16 or a free space may be provided at the top, especially in the central region within the profile 16.

The embodiment of FIG. 5 differs from that of FIG. 4 only in that the soft-elastic core 17 is provided with an open-topped, transversely extending V-notch in the vicinity of the bend. In this way it is primarily the hard-elastic profile shell 16 which becomes active on loading of the flexor 15. It is only when a predetermined angular position of the ski shoe relative to the ski top has been achieved that the soft-elastic core 17 additionally becomes active, viz. when the two cut edges of the V-notch engage one another. In FIG. 5 the V-notch is referenced 30.

The soft-elastic core 17 may comprise further approximately V-shaped notches corresponding to the notch 30 and extending approximately parallel to the notch 30. It is preferred that the depth of such further V-notches and their included angle should be somewhat less than the depth and the included angle of the notch 30, respectively. By way of the further approximately V-shaped notches and their dimensioning it is possible to provide for optimum adjustment of the flexor 15 relative to the desired resistance characteristic of FIG. 3.

Figure 7:
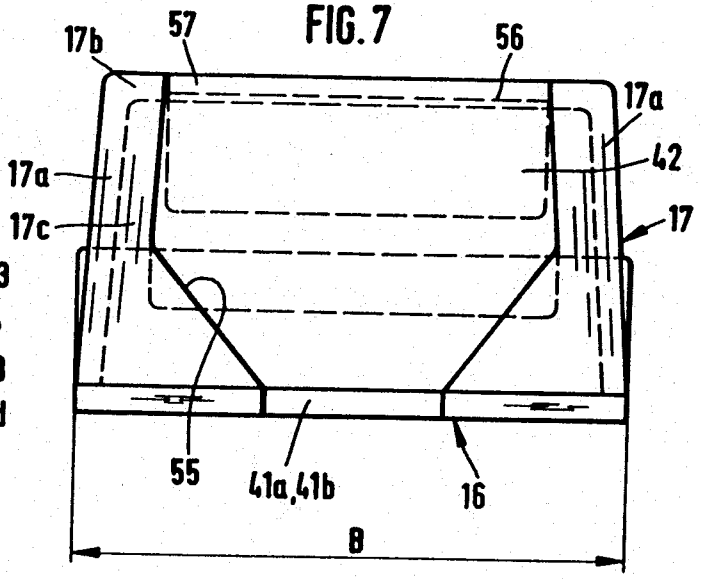
FIG. 7 is a rear view of the flexor shown in FIG. 6.
Figure 6:
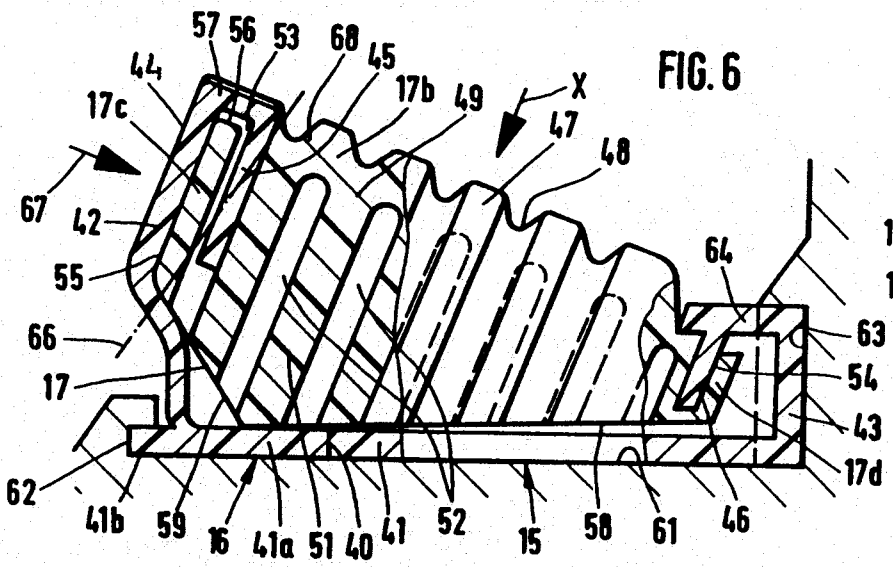
FIG. 6 is a vertical partial section of a third embodiment of a binding in accordance with the invention.
Figure 8:
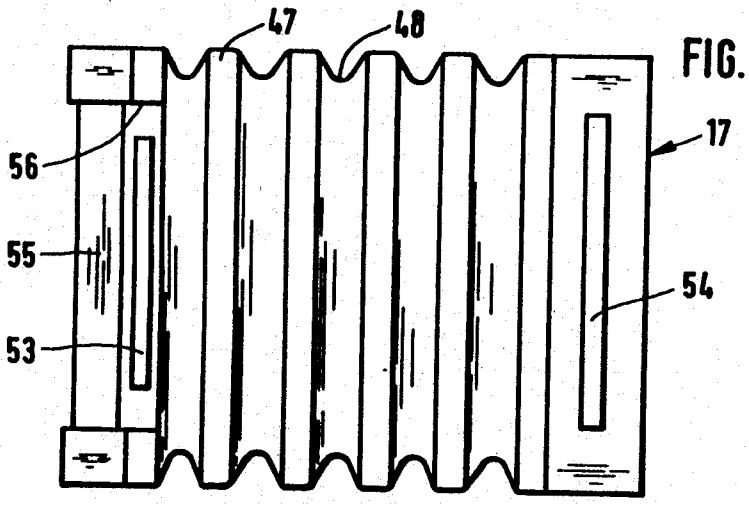
FIG. 8 is a plan view along the arrow X of FIG. 6 illustrating the soft-elastic portion of the bipartite flexor of FIG. 7.

In the embodiment shown in FIGS. 6 to 8, the profile shell 16 which likewise extends transversely to the ski has approximately U-shaped cross-section including a web 41 which extends parallel to the ski and from which a rear arm 42 and a front arm 43 extend upwardly The rear arm 42 is dimensioned to be longer, i.e. higher, than the front arm 43 and is also disposed at a forward inclination so that its outer pressure face 44 extends obliquely forwardly to match the corresponding front-side portion of the ski shoe or the ski shoe sole. It is preferred that the rear arm 42 in its base portion initially extends obliquely backwards and thereafter obliquely forwards.

The top ends of the arms 42, 43 are formed like hooks to extend towards one another whereby downwardly directed retaining webs 45, 46 are formed which extend across the ski. The front arm 43 is only about half as long as the rear arm 42 and is normal to the web 41.

In the present embodiment the soft-elastic core 17 is formed by a parallelepipedic open-bottomed hollow body comprising two opposing side walls 17*a*, an upper boundary wall 17*b*, a rear end wall 17*c* and a front end wall 17*d*. To match with the different heights of the arms 42, 43, the core 17 has approximately wedge-shape so that its end faces are covered by the arms 42, 43. The sidewalls and the upper boundary wall extend meander-like or undulating in longitudinal direction so that a corresponding profile is obtained externally and internally, wherein the internal and the externally visible wave crests and troughs 48 merge into one another at the upper longitudinal edges. Ridge-like cross-walls 51, which extend transversely and upright across the entire height of the core 17, are formed integrally with the internal wave crests 49, wherein open-bottomed slots 52 are formed between the cross-walls 51 to define the cavity of the core 17. The cross-walls 51 preferably extend at a forward inclination, i.e. in parallel with the pressure surface 44 of the rear arm 42. In the vicinity of the rear and front end walls or, respectively, the rearmost and foremost slots 52, open-topped receiving slots 53, 54 are provided into which the retaining webs 45, 46 are fitted from above whereby the core 17 is positively secured. The retaining webs 45, 46 and the receiving slots 53, 54 are dimensioned so as to be narrower than the width B of the profile shell 16 or the core 17, respectively.

As will be particularly apparent from FIG. 7, the rear end 40 of the web 41 is stepped centrally of its width so that a central, rearwardly extending web portion 41*a* results. In the vicinity of the web portion 41*a*, the rear arm 42 is integrally formed therewith and extends to diverge upwardly such that its width is greater than the width of the web portion 41*a* but less than the width B of the profile 16. The rear end of the core 17 is provided with a rear recess and a top recess 55 and 56, respectively, in which the rear arm 42 and its upper arm portion 57 to which the retaining web 45 is joined are preferably accommodated in positive fashion so that they are flush-mounted. Hence, at the rear the pressure surface 44 terminates with the rear end face of the core 17.

On its underside the core 17 has a forward surface portion 58 extending substantially parallel to the web 41 and a rearward surface portion 59 which extends obliquely upwardly and is matched with the inclination of the rear arm 42 in the base portion thereof. The apex between these two surface portions 58, 59 is beneath the front edge of the rear arm 42 or its retaining web 45, respectively.

In the case of this embodiment, the flexor 15 consisting of the profile shell 16 and the core 17 is also fitted in an insertion mount on the binding or the ski and is positively retained therein To this end a seat or recess 61 is provided on the binding or the ski with a respective front and rear undercut 62 and 63. The front end of the profile shell 16 as a whole is in engagement in the front undercut 63, wherein the edge portion of the undercut 63 overlaps the front arm 43 or the arm portion 64 thereof to which the retaining web 46 is joined. At the rear end of the flexor 15, a rearward extension 41*b* of the web portion 41*a* is in engagement with the rear undercut 62. Due to the existing flexibility of the profile 16, the flexor 15 may be fitted from above into the recess 61. This applies also to the core 17 which is fitted from above into the hard-elastic profile 16.

FIG. 6 includes a dash-dot line 66 in the vicinity of the rear end of the flexor 15 to indicate the rear end of the pressure surface 44 in the compressed state into which the flexor 15 is compressed by the upwardly-pivoted ski shoe 11 in the direction of the arrow 67. During such compression the flank portions 68 of the undulating boundary wall of the core 17 bend inwards so that the distance between the cross-walls 51 is decreased and the outer wave crests 47 may expand outwardly, i.e. towards the sides and the top. In the present configuration, the reaction force of the core 17 or the flexor 15 is substantially uniform throughout the entire range of compression.

It is also possible within the concept of the invention to mount the core 17 on the binding or the ski without a hard-elastic profile shell 16, in which case the ski shoe 11 will directly engage the rear end of the soft-elastic core. Such a flexor may include retaining members which act positively at the front and the rear, and it may be fixed positively to the binding with these retaining members.

In the described embodiments, the hard-elastic profile 16 is preferably made of a plastics material with a Shore hardness of 80 to 95, whereas the soft-elastic core 17 is made of a material with a Shore hardness of about 20 to 35.

I claim:

1. A cross country ski binding for securing the toe portion of a boot to a ski and permitting raising of the heel of the boot from the ski, comprising a binding shell integrally formed of hard plastic and including a base wall adapted to be fixedly attached to the top of the ski and having a plate-like rear wall secured to said base wall and located for direct engagement with the forwardmost end of the sole of the boot, said binding shell having a front wall secured to said base wall forming a chamber extending upwardly from the base wall, a flexible resilient flexor member located within said chamber of said shell and having a rear flexor wall abutting said rear wall of said shell and at least a second wall engaging said second front wall of said shell, said walls including interconnecting elements to releasably secure the flexor member in said shell, said flexor member including an outer hollow body having a top wall connected to said rear flexor wall front, said wall, and side walls of said flexor member to define a downwardly opening chamber, said top wall having a plurality of parallel ridges separated by grooves and extending in laterally parallel relation across the binding and having a plurality of interior wall members located in alignment with said ridges and projecting downwardly within the hollow body, said flexor member being formed of a flexible plastic material and permitting deformation of said top, side and interior walls from an initial unstressed state in response to lifting of the heel from the ski.

2. The binding of claim 1, wherein said rear flexor wall and said interior wall members are essentially parallel to each other and to the inclination of the forwardmost end of the boot sole with the heel resting on the ski.

3. The ski binding of claim 1, wherein said rear wall of said shell has a bottom hinged lower portion integral with said base, said hinged lower portion extending upwardly and rearwardly to an upper flat wall portion aligned with the forwardmost end of the ski sole, said flexor member having said rear flexor wall projecting from said top wall in alignment with said flat wall and hinged lower portion, and said rear walls of said housing and flexor member being connected.

4. The ski binding of claim 3, wherein said rear flexor wall includes a top opening projecting downwardly through said rear wall, said rear wall of said shell having a depending lip mating with said top opening.

5. The ski binding of claim 1, wherein said rear flexor wall is inclined forwardly toward the front of said binding and said interior wall members are flat walls parallel to said rear wall.

6. The ski binding of claim 5, wherein said side walls include grooves aligned with said top grooves and extending parallel to said interior wall members.

7. The ski binding of claim 1, wherein said rear and front walls of said shell have inwardly directed hook-like retaining webs (45, 46) formed integrally with upper ends of said rear and front walls (42, 43), said flexible resilient flexor member (17) having receptacles (53, 54) engaging said webs.

* * * * *

UNITED STATES PATENT AND TRADEMARK OFFICE

CERTIFICATE OF CORRECTION

PATENT NO. : 5,228,714

DATED : July 20, 1993

INVENTOR(S) : WALTER DEKANOVSKY

It is certified that error appears in the above-identified patent and that said Letters Patent is hereby corrected as shown below:

Claim 1, col. 7, line 5, delete "second" and substitute therefor ---front flexor; Claim 1, col. 7, line 6, delete "second"; Claim 1, col. 7, line 10, after "wall" delete "front"; Claim 1, col. 7, line 10, after "said" and before "wall" insert ---front---; Claim 1, col. 7, line 10, after "wall" insert ---,---(comma); Claim 1, col. 7, line 20, delete "walls" and substitute therefor ---wall members---.

Signed and Sealed this

Twenty-ninth Day of March, 1994

Bruce Lehman

*Attest:*

BRUCE LEHMAN

*Attesting Officer*

*Commissioner of Patents and Trademarks*